US006605802B2

(12) United States Patent
Nagahira

(10) Patent No.: US 6,605,802 B2
(45) Date of Patent: Aug. 12, 2003

(54) IMAGE HEATING APPARATUS AND HEAT GENERATING ROTARY MEMBER FOR USE IN THE SAME

(75) Inventor: Joji Nagahira, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/921,701

(22) Filed: Aug. 6, 2001

(65) Prior Publication Data

US 2002/0020699 A1 Feb. 21, 2002

(30) Foreign Application Priority Data

Aug. 11, 2000 (JP) ..... 2000-244726

(51) Int. Cl.[7] ..... H05B 6/14

(52) U.S. Cl. ..... 219/619; 399/330; 399/333; 399/334

(58) Field of Search ..... 219/619, 634–653, 219/659, 647, 649, 216; 399/69, 330, 332, 336, 334, 335, 328, 333, 45

(56) References Cited

U.S. PATENT DOCUMENTS

| | | | | |
|---|---|---|---|---|
| 4,482,243 A | | 11/1984 | Suzuki et al. | 355/14 D |
| 5,768,673 A | | 6/1998 | Morigami | 399/330 |
| 6,097,926 A | * | 8/2000 | Takagi et al. | 399/328 |
| 6,246,035 B1 | * | 6/2001 | Okuda | 219/619 |

FOREIGN PATENT DOCUMENTS

| | | |
|---|---|---|
| JP | 9-127810 | 5/1997 |

* cited by examiner

*Primary Examiner*—Quang T. Van
(74) *Attorney, Agent, or Firm*—Fitzpatrick, Cella, Harper & Scinto

(57) ABSTRACT

An object of the present invention is to provide an image heating apparatus for heating an image formed on a recording material that has a heating member, and an excitation coil for generating a magnetic field to induce an eddy current in the heating member, the heating member having a magnetic metallic layer and a non-magnetic metallic layer, the coil being disposed on the magnetic metallic layer side of the heating member.

9 Claims, 6 Drawing Sheets

IMAGE HEATING APPARATUS AND HEAT GENERATING ROTARY MEMBER FOR USE IN THE SAME

BACKGROUND OF THE INVENTION

1. Field of the Invention

This invention relates to an image heating apparatus like a heating and fixing device mounted on an image forming apparatus such as a copier or a printer and a heat generating rotary member for use in this apparatus, and more particularly to an image heating apparatus of the induction heating type and a heat generating rotary member for use in this apparatus.

2. Related Background Art

A heating apparatus of the induction heating type causes a magnetic field to act on a magnetic metallic member (an electromagnetic induction heat generating member, an induction magnetic material or a magnetic field absorbing electrically conducting material), and effects the heating of a material to be heated by the heat generation by an induced current (a high frequency induced current or an eddy current) produced in the magnetic metallic member, and is effective, for example, as an image heating and fixing apparatus for heating a recording material on which an unfixed toner image is formed and borne and fixing the unfixed toner image as a permanent secured image in an image forming apparatus of the electrophotographic type, the electrostatic recording type, the magnetic recording type or the like.

As an example of the fixing apparatus of the induction heating type, there is disclosed in Japanese Patent Application Laid-Open No. 9-127810 an induction heating and fixing apparatus of the heat roller type for introducing a sheet on which an unfixed toner image is formed into the pressure contact nip portion between an induction-heated fixing roller and a pressure roller and causing the sheet to be nipped and conveyed therebetween, and heating and fixing the unfixed toner image on the sheet by the heat of the fixing roller, characterized by a construction in which the fixing roller is comprised of a hollow metallic roller having good heat conductivity and a non-magnetic characteristic, and a magnetic metallic thin layer of a magnetic metal formed on the outer periphery of the hollow metallic roller, and an induction coil for inducing an induction current in the magnetic metallic thin layer for heating is disposed in the hollow metallic roller.

In this induction heating and fixing apparatus, the fixing roller is constructed with the magnetic metallic thin layer which is a heat generating member being formed on the outer periphery of the non-magnetic hollow metallic roller having good heat conductivity and therefore, by the hollow metallic roller formed of a non-magnetic metal hardly generating heat and functioning as a mandrel and the lowered heat capacity of the heat generating member, it becomes possible to secure mechanical strength sufficiently, and yet achieve rapid temperature rise and the shortening of the pre-heating time.

However, the magnetic flux coupled to the magnetic metallic layer becomes reduced by the non-magnetic metallic layer between the coil and the magnetic metallic layer, and heat generating efficiency could not be said to be sufficiently high.

SUMMARY OF THE INVENTION

The present invention has been made in view of the above-noted problem and an object thereof is to provide an image heating apparatus excellent in heat generating efficiency and a heat generating rotary member used in this apparatus.

Another object of the present invention is to provide an image heating apparatus which can suppress the temperature rise of a non-sheet passage portion and a heat generating rotary member used in this apparatus.

Still another object of the present invention is to provide an image heating apparatus comprising:

a heating member; and an excitation coil for generating a magnetic field to induce an eddy current in the heating member;

the heating member having a magnetic metallic layer and a non-magnetic metallic layer, the coil being disposed on the magnetic metallic layer side of the heating member.

Yet still another object of the present invention is to provide a heat generating rotary member having:

a magnetic metallic layer; and a non-magnetic metallic layer provided on the outer side of the magnetic metallic layer.

Further objects of the present invention will become apparent from the following detailed description when read with reference to the accompanying drawings.

DETAILED DESCRIPTION OF THE PREFERRED EMBODIMENTS

First Embodiment (1) An Example of an Image Forming Apparatus

Figure 1:
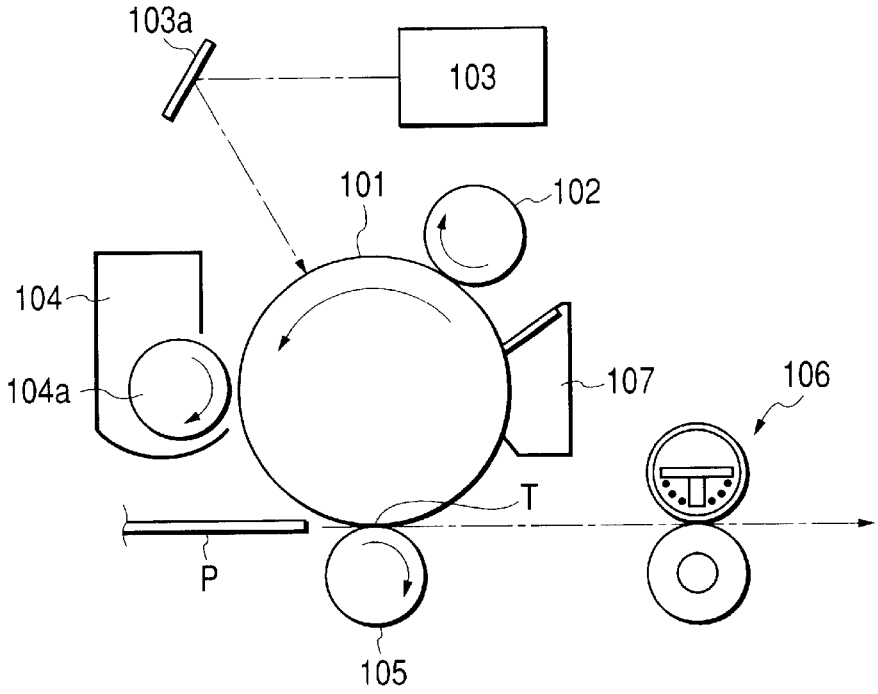
FIG. 1 schematically shows the construction of an image forming apparatus in a first embodiment.

FIG. 1 is a schematic construction model view of an image forming apparatus in the present embodiment. The image forming apparatus of the present embodiment is a laser beam printer utilizing the transfer type electrophotographic process.

The reference numeral 101 designates an electrophotographic photosensitive drum as an image bearing member rotatively driven at a predetermined peripheral speed in the clockwise direction of arrow.

The reference numeral 102 denotes a charging roller having electrical conductivity and elasticity and brought into contact with the photosensitive drum 101 with a predetermined pressure force, and rotated following the rotation of the photosensitive drum 101. A predetermined charging bias voltage is applied from a power supply portion not shown, to this charging roller 102 whereby the peripheral surface of the rotating photosensitive drum 101 is uniformly contact-charged to a predetermined polarity and potential.

The reference numeral 103 designates an exposing apparatus as information writing means. This exposing apparatus is a laser scanner which outputs a laser beam modulated correspondingly to the time-serial electrical digital pixel signal of image information, and scans and exposes the uniformly charged surface of the rotating photosensitive drum 101 through the intermediary of a turn-back mirror 103*a*. Thereby, an electrostatic latent image corresponding to the scanning and exposing pattern is formed on the surface of the photosensitive drum 101.

The reference numeral 104 denotes a developing apparatus for developing the electrostatic latent image formed on the surface of the photosensitive drum 101 as a toner image. The reference character 104*a* designates a developing roller having a predetermined developing bias voltage applied thereto from the power supply portion, not shown.

The reference numeral 105 denotes a transferring roller having electrical conductivity and elasticity as transferring means, and brought into pressure contact with the photosensitive drum 101 with a predetermined pressure force to thereby form a transferring nip portion T. A recording sheet (transferring material) P as a recording material is fed from a sheet feeding portion, not shown, to this transferring nip portion T and is nipped and conveyed thereby, and the toner image on the surface of the photosensitive drum 101 is sequentially transferred to the surface of the recording sheet P. An appropriate bias voltage of a polarity opposite to the charging polarity of the toner is applied from the power supply portion, not shown, to the transferring roller 105 at predetermined control timing.

The reference numeral 106 designates a heating apparatus (image heating and fixing apparatus) for heating and fixing the unfixed toner image, and the recording sheet P passed through the transferring nip portion T is sequentially separated from the surface of the photosensitive drum 101 and is introduced into this heating apparatus 106, whereby the toner image on the recording sheet P is heated and pressurized and is fixed on the recording sheet P. The recording sheet P passed through the heating apparatus 106 is discharged as an image-formed article (a copy or a print). The heating apparatus 106 is a heating apparatus of the induction heating type according to the present invention, and will be described in detail in the next paragraph (2).

The reference numeral 107 denotes a photosensitive drum surface cleaning apparatus for removing photosensitive drum surface contaminants such as the untransferred toner and paper dust residual on the surface of the photosensitive drum 101 after the separation of the recording sheet and cleaning the drum surface. The surface of the photosensitive drum cleaned by the cleaning apparatus 107 is repeatedly used for image formation.

(2) Heating Apparatus 106 a) General Construction of the Apparatus

Figure 2:
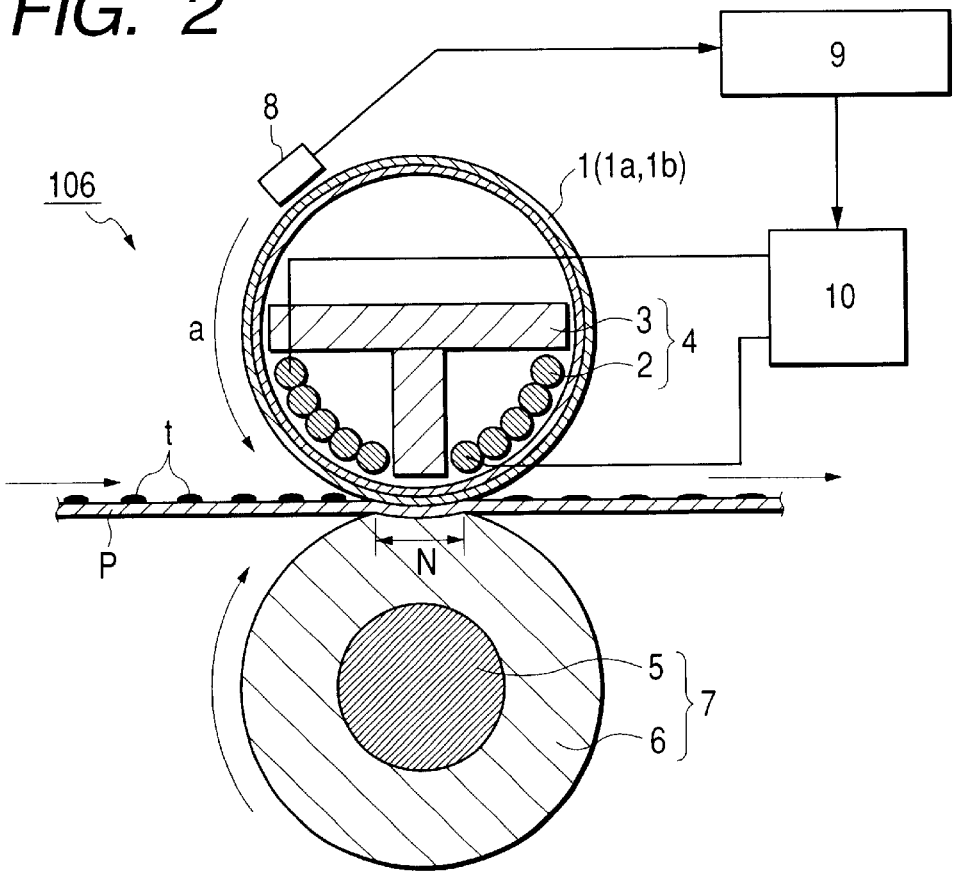
FIG. 2 is a transverse cross-sectional model view of a heating apparatus (image heating and fixing apparatus) in the first embodiment.

FIG. 2 is a transverse cross-sectional model view of the heating apparatus 106. The heating apparatus 106 of the present embodiment is of a heat roller type which introduces the recording sheet P having the unfixed toner image t formed thereon into the fixing nip portion N which is the pressure contact portion between a fixing roller 1 as a heating rotary member induction-heated and a pressure roller 7 and nips and conveys the recording sheet P, and heats and fixes the unfixed toner image t on the recording sheet P by the heat of the fixing roller 1.

Figure 3:
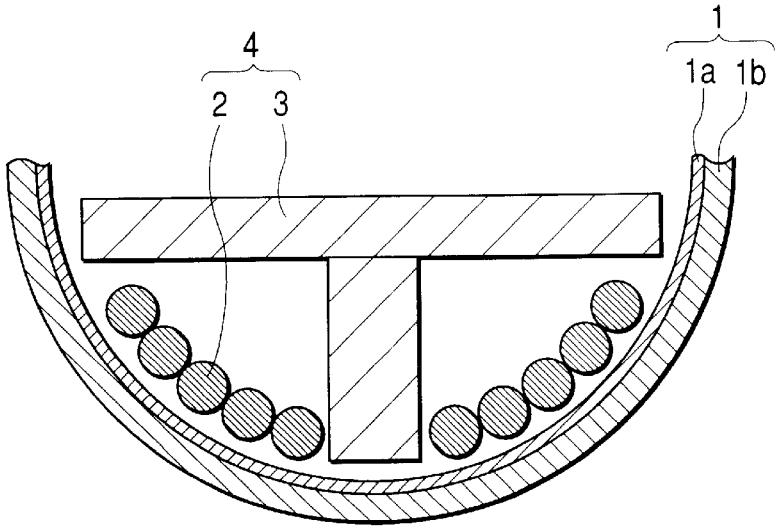
FIG. 3 is an enlarged model view of the essential portions of the heating apparatus shown in FIG. 2.

The fixing roller 1, as shown in FIG. 3, is a cylindrical roller of two-layer laminated structure comprising an inner magnetic metallic layer 1*a* and an outer non-magnetic metallic layer 1*b*, and is disposed with its opposite end portions rotatably bearing-held between the side plates of the chassis, not shown, of the apparatus. This fixing roller 1 is rotatively driven at a predetermined peripheral speed in the counter-clockwise direction of arrow a by a driving system, not shown.

The pressure roller 7 is comprised of a mandrel 5 and a heat-resistant elastic material layer 6 of silicone rubber, fluorine rubber, fluorine resin or the like covering this mandrel concentrically and integrally therewith in the form of a roller, and is disposed under the fixing roller 1 with the opposite end portions of the mandrel 5 rotatably bearing-held between the side plates of the chassis, not shown, of the apparatus, and also is brought into pressure contact with the underside of the fixing roller 1 with a predetermined pressure force by biasing means, not shown, and the heat-resistant elastic material layer 6 of the pressure roller 7 is deformed against the elasticity thereof in the pressure contact portion with the fixing roller 1, whereby the fixing nip portion N of a predetermined width as a heating portion for heating a material to be heated is formed between the pressure roller 7 and the fixing roller 1. The pressure roller 7 is rotated following the rotative driving of the fixing roller 1 or is rotatively driven.

The reference numeral 4 designates magnetic field generating means which is an assembly of an induction coil 2 and a magnetic core (excitation core) 3 having a T-shaped transverse cross-section. The magnetic field generating means 4 including the induction coil 2 is inserted in the inner side of the fixing roller 1 which is the magnetic metallic layer 1*a* side of the fixing roller 1. The induction coil 2 is formed by a copper wire wound by a plurality of turns in one direction, and the magnetic core 3 is disposed so as to be orthogonal to the copper wire of the induction coil 2 and forms a magnetic path. The magnetic core 3 is formed of a magnetic material, and comprises, for example, a ferrite core or a laminated core.

The magnetic field generating means 4 inserted in the fixing roller 1 is non-rotatably supported with its opposite end portions fixed between the side plates of the chassis, not shown, of the apparatus, and is disposed in non-contact with the inner peripheral surface of the fixing roller 1 with a predetermined gap kept between it and the inner peripheral surface of the fixing roller 1.

Thus, by an alternating magnetic field generated by the fixing roller 1 being rotatively driven, and the pressure roller 7 being also rotated, and a high frequency current being applied from an excitation circuit 10 to the induction coil 2 of the magnetic field generating means 4, a high frequency induce induced current is induced in the inner magnetic metallic layer 1*a* of the fixing roller 1 and this magnetic metallic layer 1*a* generates heat by electromagnetic induction, and the heat is conducted to the outer non-magnetic metallic layer 1*b* of the fixing roller 1, and the fixing roller 1 is heated and in a state in which it has risen to a predetermined temperature, the recording sheet P as a material to be heated is introduced into the fixing nip portion N and is nipped and conveyed, whereby the unfixed toner image is heat-and-pressure-fixed on the recording sheet P by the heat and nip pressure of the fixing roller 1.

The reference numeral 8 denotes a temperature detecting element such as a thermistor which detects the temperature of the fixing roller 1, and the information of the detected temperature is inputted to a control circuit 9. On the basis of the inputted information of the detected temperature, the control circuit 9 controls the supply of electric power from the excitation circuit 10 to the induction coil 2 so that the temperature of the fixing nip portion N or the surface temperature of the fixing roller 1 may be controlled to a predetermined fixing temperature.

b) Fixing Roller 1

The fixing roller 1 as the induction-heated heating rotary member in the present embodiment, as previously described, is a cylindrical roller of two-layer laminated structure comprising the inner magnetic metallic layer 1*a* and the outer non-magnetic metallic layer 1*b*.

The outer non-magnetic metallic layer 1*b* functions as a roller base, and improves the securement of the mechanical strength and the heat conduction of the entire fixing roller. The non-magnetic metal forming this layer 1*b* may suitably be a material having good heat conductivity and a non-magnetic characteristic, and having relative permeability of about 1 and heat conductivity of 200 W/(m·k) or greater at 200° C., and is for example, aluminum, copper or silver or an alloy thereof. The thickness of the non-magnetic metallic layer 1*b* is determined with consideration taken so as to satisfy the mechanical strength of the entire fixing roller required in conformity with the diameter of the roller and yet achieve an improvement in the heat conduction thereof.

The inner magnetic metallic layer 1*a* functions as a heat generating member. The magnetic metal forming this layer 1*a* is, for example, iron, cobalt, nickel, copper, chromium, SUS 430, a nickel-iron alloy or the like generally having relative permeability of about 100 or greater, and the greater is the relative permeability, the higher becomes the magnetic flux density and the easier becomes heat generation.

The function of securing the mechanical strength of the entire fixing roller is not required of this magnetic metallic layer 1*b*, and the thickness of this layer is made as small as possible with a desired temperature rising time and a moldable range or the like taken into account to thereby achieve a lower heat capacity. Generally, the thickness of this layer is e.g. 1 $\mu$m to 100 $\mu$m, and this layer is formed on the inner peripheral surface of the outer non-magnetic metallic layer 1*b* as the fixing roller base by a conventional film attaching method such as plating, vapor deposition, sputtering or coating. It may also be so-called clad steel composed of aluminum clad with stainless steel.

By an alternating magnetic field generated by a high frequency current being applied from the excitation circuit 10 to the induction coil 2 of the magnetic field generating means 4, a high frequency induced current is induced in the inner magnetic metallic layer 1*a* of the fixing roller 1 and the magnetic metallic layer 1*a* generates heat by electromagnetic induction, and the heat is conducted to the outer non-magnetic metallic layer 1*b* of the fixing roller 1, which is thus heated.

(1) In this case, the magnetic field generating means 4 including the induction coil 2 is disposed in the inner side of the fixing roller which is the magnetic metallic layer 1*a* side and therefore, the magnetic flux generated by the electrical energization of the induction coil 2 is not decreased in the amount of the magnetic flux, but directly reaches the magnetic metallic layer 1*a* and can cause the magnetic metallic layer 1*a* to efficiently generate heat by electromagnetic induction, and the heat generating efficiency is good.

(2) The heat conduction of the entire fixing roller is improved by the characteristic of the good heat conductivity of the outer non-magnetic metallic layer 1*b* as the fixing roller base, and the heat of the magnetic metallic layer 1*a* is easily conducted in the lengthwise direction and circumferential direction of the fixing roller through the non-magnetic metallic layer 1*b*.

Therefore, even in the case of a mode in which recording sheets of a size smaller than the maximum width of supplied sheets are continuously supplied, the difference between the temperature in the sheet-supplied area of the fixing roller 1 and the temperature in the non-sheet-supplied area of the fixing area becomes small and the temperature irregularity caused can be made small.

As the result of the temperature irregularity of the fixing roller 1 being thus suppressed, it comes to never happen that the heat resisting life of the surrounding members is reduced or the surrounding members suffer from thermal damage and further, even when a recording sheet of a large size is supplied immediately after the aforedescribed mode, partial irregularity can be prevented from occurring to the fixing property.

(3) Accordingly, it becomes possible to sufficiently secure mechanical strength and yet achieve the shortening of the pre-heating time and further, suppress temperature irregularity and secure and realize stable fixing performance in any sheet supplying mode.

Second Embodiment

Figure 4A:
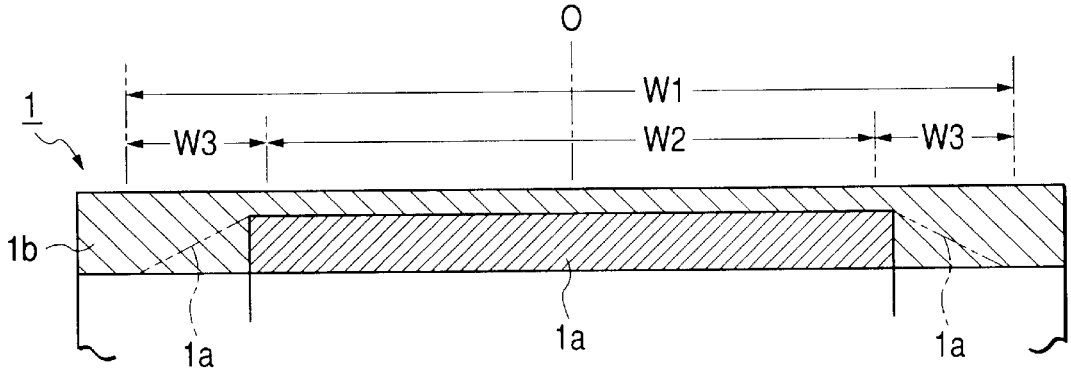
FIGS. 4A and 4B are illustrations of the construction of a heating apparatus in a second embodiment.
Figure 4B:
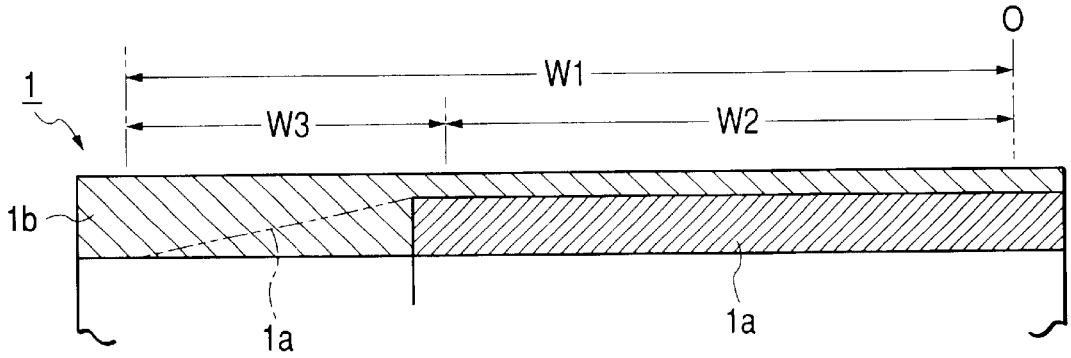

This embodiment is such that in the heating apparatus 106 of the above-described first embodiment of the widths of the magnetic metallic layer 1*a* and non-magnetic metallic layer 1*b* constituting the fixing roller 1 in the lengthwise direction of the roller, as shown in the model view of FIG. 4A or 4B, the width of the magnetic metallic layer 1*a* is made shorter than that of the non-magnetic metallic layer 1*b*.

That is, FIG. 4A shows the case of an apparatus in which sheet supply is effected with the center reference O, and FIG. 4B shows the case of an apparatus in which sheet supply is effected with the one side reference O, and when in the respective figures, W1 is the width of the sheet supply area for a recording sheet of a large size and W2 is the width of the sheet supply area for a recording sheet of a small size, the width of the non-magnetic metallic layer 1*b* in the lengthwise direction of the roller is a width dimension covering the width W1 of the sheet supply area for the recording sheet of the large size, and the width of the magnetic metallic layer 1*a* in the lengthwise direction of the roller is a width dimension equal to or a little greater than the width W2 of the sheet supply area for the recording sheet of the small size, and the magnetic metallic layer 1*a* does not exist in that portion of the non-magnetic metallic layer which corresponds to the width W3 (W1–W2) of a non-sheet supply area when the recording sheet of the small size is supplied.

By adopting such a construction, in addition to the achievement of the effects (1), (2) and (3) similar to those of the heating apparatus 106 of the first embodiment, (4) the excessive temperature rise of the non-sheet supply portion during the continuous supply of recording sheets of the small size can be prevented more effectively. Again, in the case of the recording sheet of the large size, the generated heat of the magnetic metallic layer 1*a* is sufficiently conducted to the end portions of the non-magnetic metallic layer 1*b* by the good heat conductive characteristic of the non-magnetic metallic layer 1*b* and the width W1 of the sheet supply area of the fixing roller 1 for the recording sheet of the large size is uniformly heated and therefore, fixing irregularity or the like does not occur.

Also, there can be made a form in which as indicated by dots-and-dash lines in FIGS. 4A and 4B, the magnetic metallic layer 1*a* exists also in the width W3 of the non-sheet supply area and the thickness thereof is made different, namely, varied, from the thickness of the magnetic metallic layer 1*a* in the width W2 of the sheet supply area for the recording sheet of the small size. What is indicated by the dots-and-dash line is a construction in which the thickness of the magnetic metallic layer 1*a* is made gradually smaller toward the end portions of the fixing roller.

Third Embodiment

Figure 5A:
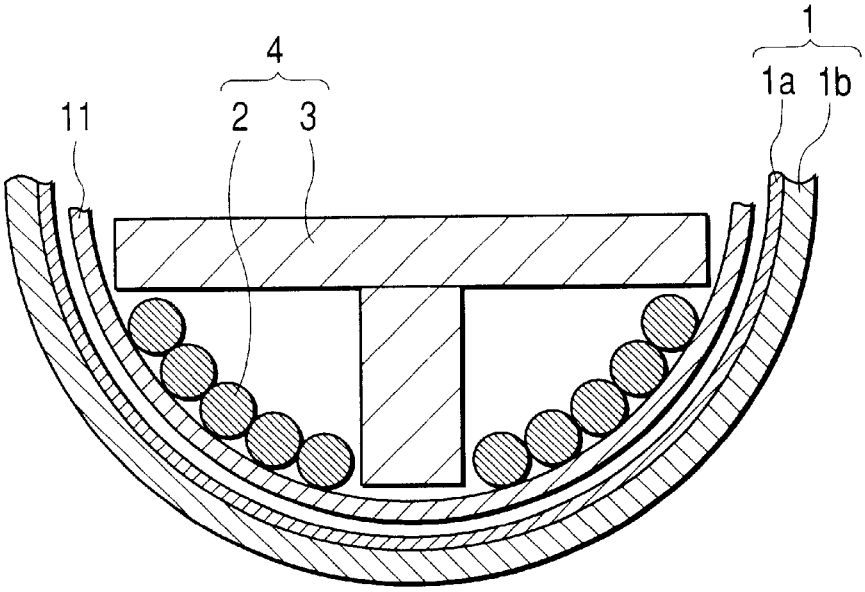
FIGS. 5A and 5B are illustrations of the construction of a heating apparatus in a third embodiment.
Figure 5B:
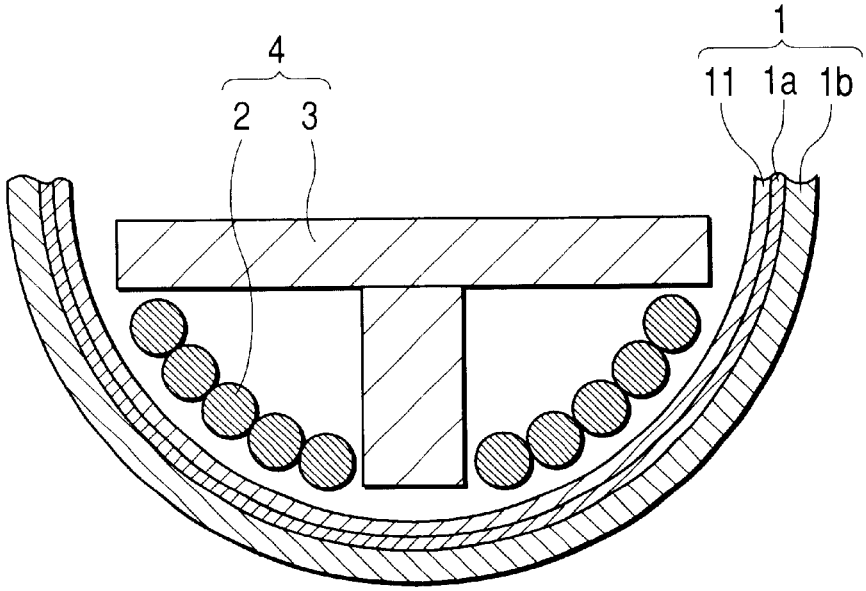

This embodiment is such that in the heating apparatus 106 of the aforedescribed first embodiment, a non-magnetic, thermally insulative and electrically insulative non-metallic member 11 is disposed between the inner magnetic metallic layer 1*a* of the fixing roller 1 and the magnetic field generating means 4 including the induction coil 2 inserted in the fixing roller 1, as shown in FIG. 5A or 5B.

In the case of FIG. 5A, the above-mentioned nonmetallic member 11 is constructed and disposed as a fixed cover member of a trough type having a semicircular transverse cross-section covering the surface of the magnetic field generating means 4 opposed to the inner surface of the fixing roller. In the case of FIG. 5B, the above mentioned non-metallic member 11 is laminated and formed on the inner surface of the fixing roller 1.

The non-metallic member 11 is a non-magnetic nonmetallic material which is high in thermal insulativeness and high in electrical insulativeness, and may suitably be a material having relative permeability of about 1, and specifically is glass, insulating ceramics or heat-resistant resin.

The magnetic flux of the alternating magnetic field generated by a high frequency current being applied to the induction coil 2 of the magnetic field generating means 4 passes through the non-magnetic nonmetallic member 11 which is high in thermal insulativeness and high in electrical insulativeness and a high frequency induced current is induced in the inner magnetic metallic layer 1*a* of the fixing roller 1 and this magnetic metallic layer 1*a* generates heat by electromagnetic induction, and the heat is conducted to the outer non-magnetic metallic layer 1*b* of the fixing roller 1, which is thus heated.

By adopting such a construction, in addition to the achievement of the effects (1), (2) and (3) similar to those of the heating apparatus 106 of the first embodiment, (5) the electrical insulation between the induction coil 2 and the entire fixing roller 1 can be secured by the non-metallic member 11.

That is, the non-metallic member 11 has an insulative characteristic and therefore can electrically intercept the electric current flowing through the induction coil 2 from the magnetic metallic layer of the fixing roller 1, and can secure electrical insulation to thereby prevent the entire apparatus from being destroyed even if, for example, the covering of the induction coil 2 is destroyed by excessive temperature rise or the like.

Also, the non-metallic member 11 has a thermally insulative characteristic and therefore can thermally shield the induction coil 2 and the magnetic metallic layer 1*a* of the fixing roller 1, and it is difficult for the heat of the fixing roller 1 to be conducted to the induction coil 2, and the temperature rise of the entire apparatus can be prevented.

Fourth Embodiment

Figure 6:
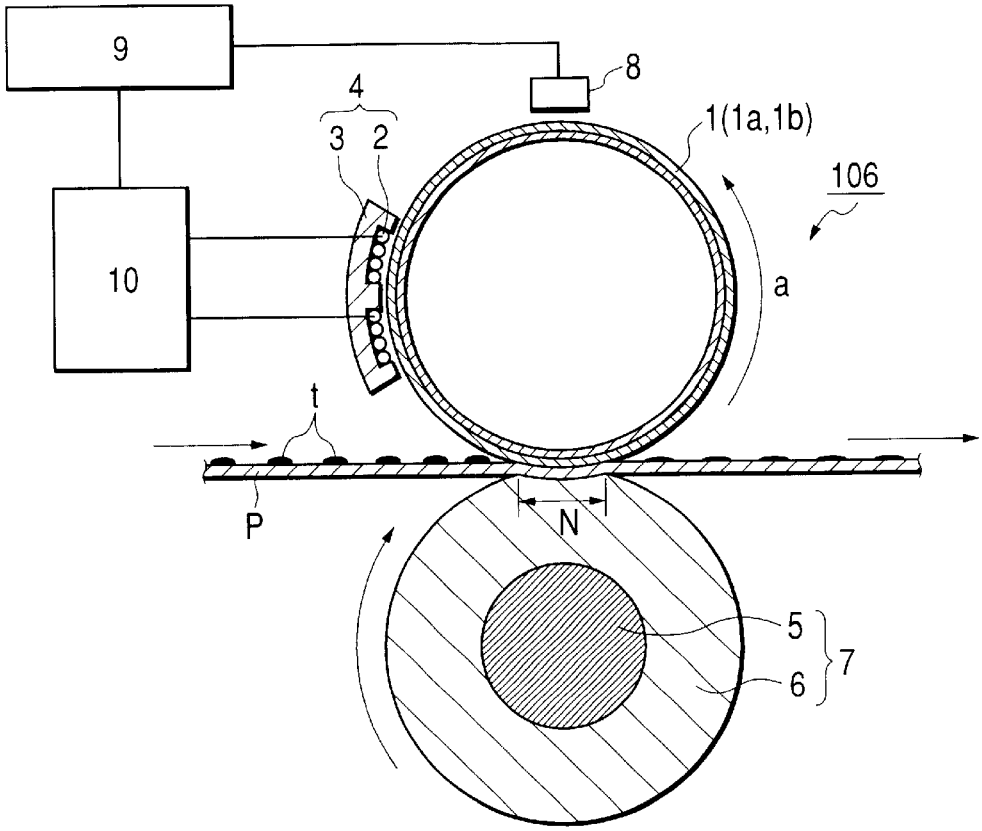
FIG. 6 is a transverse cross-sectional model view of a heating apparatus in a fourth embodiment.
Figure 7:
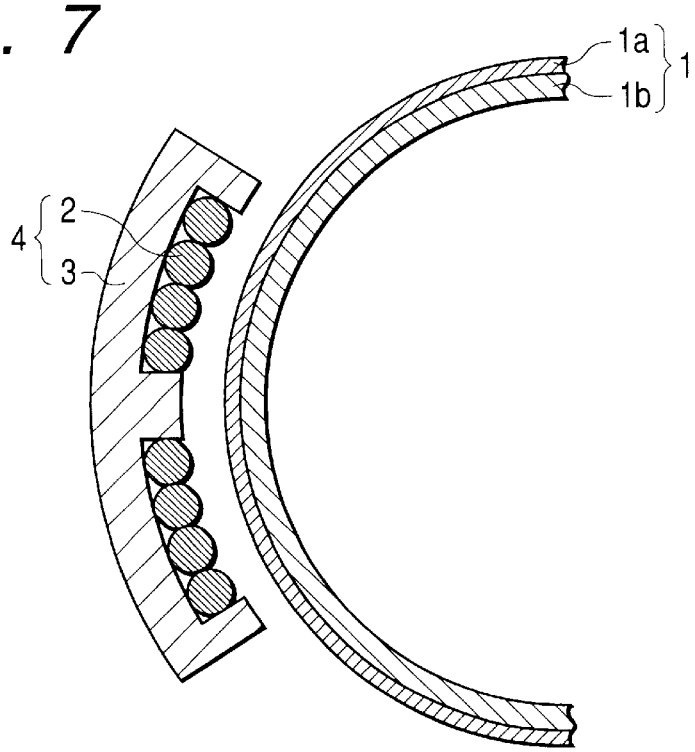
FIG. 7 is an enlarged model view of the essential portions of the heating apparatus shown in FIG. 6.

This embodiment is a modification of the heating apparatus 106 of the aforedescribed first embodiment, and as shown in the model views of FIGS. 6 and 7, the layer construction of the fixing roller 1 is changed to two-layer laminated structure in which the magnetic metallic layer 1*a* is made outer and the non-magnetic metallic layer 1*b* is made inner, and the magnetic field generating means 4 including the induction coil 2 is fixed to and disposed on the outer side of the roller which is the magnetic metallic layer 1*a* side in opposed relationship with the fixing roller 1. In the other points, the construction of the apparatus of the present embodiment is similar to that of the heating apparatus 106 of the first embodiment and therefore need not be described.

Again in the apparatus of the present embodiment, the induction coil 2 is located adjacent to the magnetic metallic layer 1*a* as the outer heat generating member of the fixing roller 1 and therefore, the magnetic flux generated by the electrical energization of the induction coil 2 can directly reach the magnetic metallic layer 1*a* without the amount of the magnetic flux being decreased to thereby cause this magnetic metallic layer 1*a* to efficiently generate heat by electromagnetic induction, and this is good in heat generating efficiency.

Accordingly, the apparatus of the present embodiment can also obtain the effects (1), (2) and (3) similar to those of the heating apparatus 106 of the first embodiment.

Fifth Embodiment

Figure 8A:
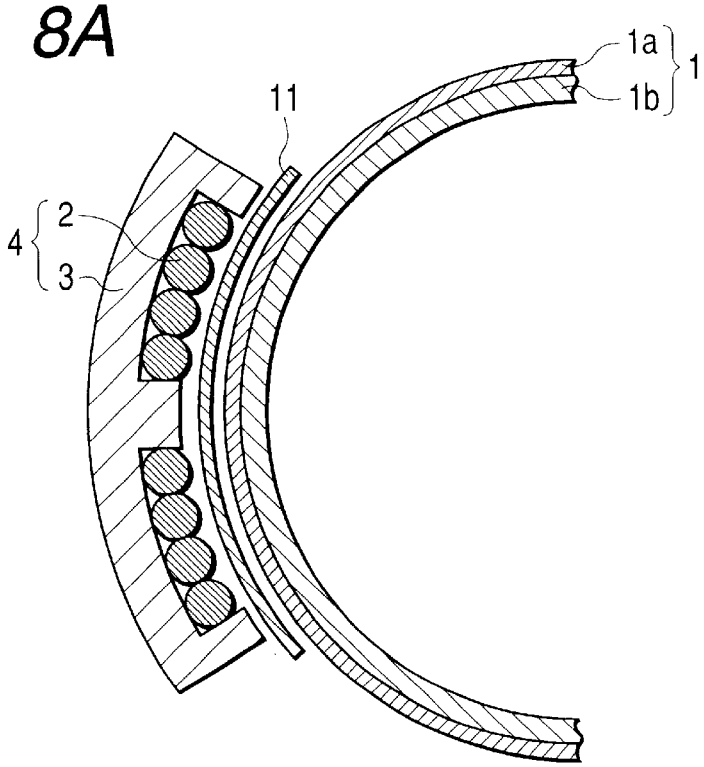
FIGS. 8A and 8B are illustrations of the construction of a heating apparatus in a fifth embodiment.
Figure 8B:
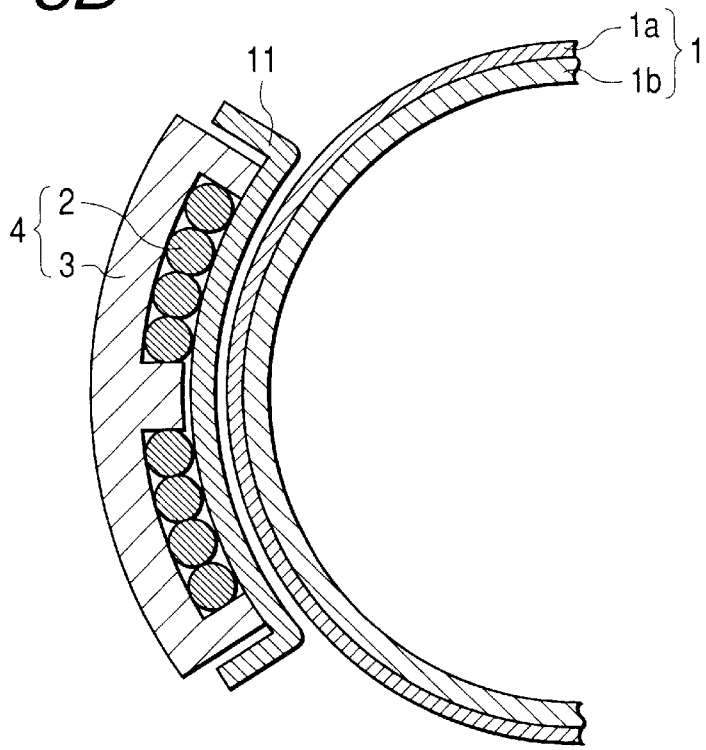

This embodiment is such that in the heating apparatus 106 of the above-described fourth embodiment, a non-magnetic, thermally insulative and electrically insulative non-metallic member 11 is disposed between the outer magnetic metallic layer 1*a* of the fixing roller 1 and the magnetic field generating means 4 including the induction coil 2 fixed to and disposed on the outer side of the roller which is the magnetic metallic layer 1*a* side in opposed relationship with the fixing roller 1, as shown in FIG. 8A or 8B.

The non-metallic member 11, like the non-metallic member 11 in the apparatus of the aforedescribed third embodiment, is a non-metallic material such as glass, insulating ceramics or heat-resistant resin which is non-magnetic and high in thermal insulativeness and high in electrical insulativeness.

Again the apparatus of the present embodiment can obtain, in addition to the effects (1), (2) and (3) similar to those of the apparatus of the aforedescribed fourth embodiment, the effect (5) by the non-metallic member 11 similar to that of the apparatus of the aforedescribed third embodiment.

Sixth Embodiment

Figure 9:
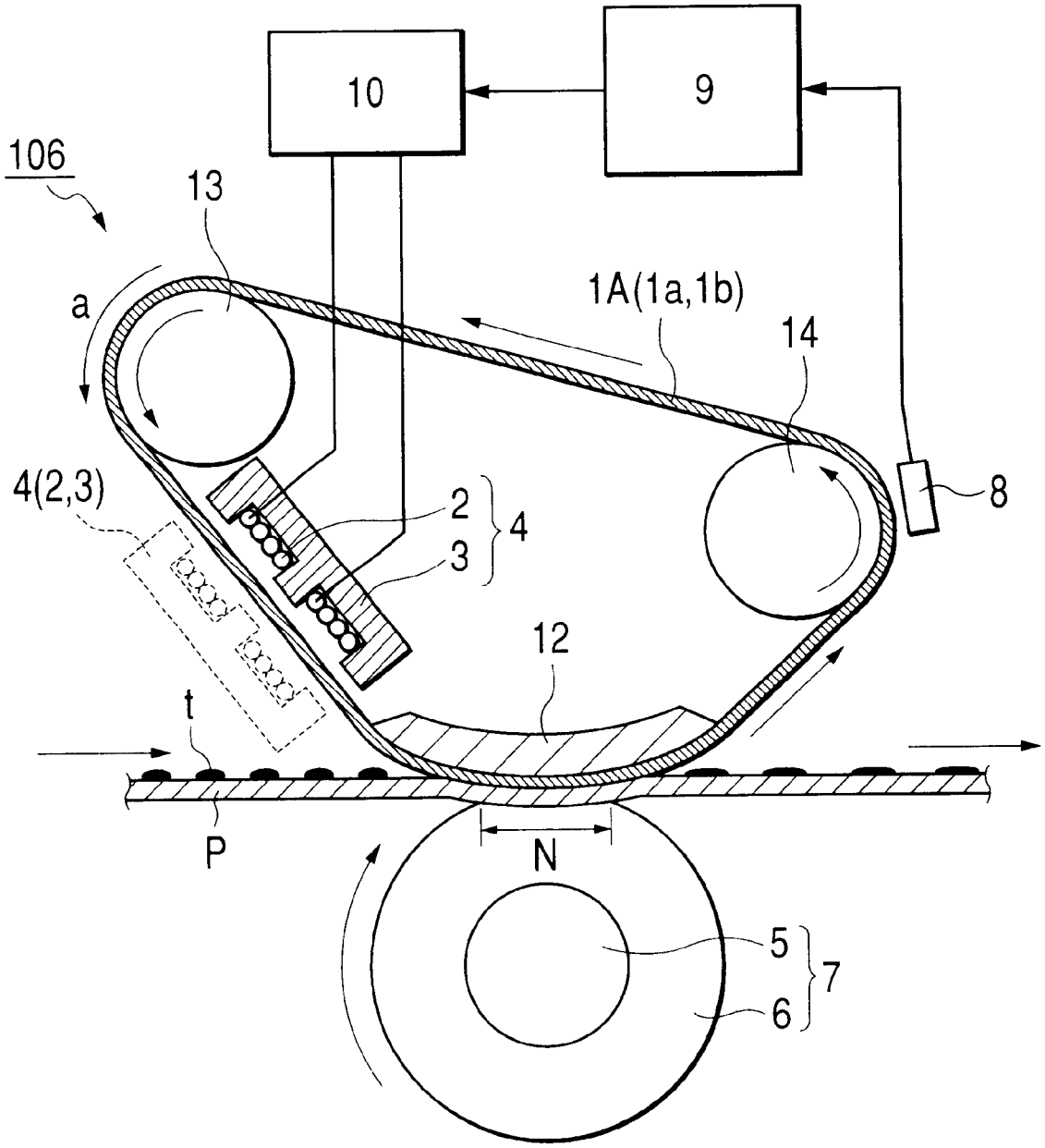
FIG. 9 is a transverse cross-sectional model view of a heating apparatus in a sixth embodiment.

In this embodiment, the induction-heated heating rotary member is constructed as flexible endless belt-like fixing film 1A as shown in FIG. 9. This fixing film 1A is passed over three members, i.e., a backup plate 12, a driving roller 13 and a tension roller 14, and is rotatively driven in the counter-clockwise direction of arrow a by the driving roller 13 being rotatively driven.

An elastic pressure roller 7 is brought into pressure contact with the underside of the backup plate 12 with a predetermined pressure force with the fixing film 1A nipped therebetween to thereby form a fixing nip portion N of a predetermined width. The pressure roller 7 rotates following the rotative driving of the fixing film 1A or is rotatively driven.

In the present embodiment, the fixing film 1A is a flexible endless belt of two-layer laminated structure comprising an inner magnetic metallic layer 1*a* and an outer non-magnetic metallic layer 1*b*. The magnetic field generating means 4 including the induction coil 2 is disposed on the inner side of the endless belt-like fixing film 1A which is the magnetic metallic layer 1*a* side.

Alternatively, the fixing film 1A may be of a laminated construction in which the magnetic metallic layer 1*a* is made outer and the non-magnetic metallic layer 1*b* is made inner, and in such case, the magnetic field generating means 4 including the induction coil 2 is disposed on the outer side of the endless belt-like fixing film 1A which is the magnetic metallic layer 1*a* side as indicated by dots-and-dash line.

Thus, by an alternating magnetic field generated by the fixing film 1A being rotatively driven and the pressure roller 7 being also rotated and a high frequency current being applied from an excitation circuit 10 to the induction coil 2 of the magnetic field generating means 4, a high frequency induced current is induced in the magnetic metallic layer 1*a* of the fixing film 1A and this magnetic metallic layer 1*a* generates heat by electromagnetic induction, and the heat is conducted to the non-magnetic metallic layer 1*b*, and the fixing film 1A is heated, and in a state in which it has risen to a predetermined temperature, a recording sheet P as a material to be heated is introduced into between the fixing film 1A and the pressure roller 7 in the fixing nip portion N and is nipped and conveyed thereby, whereby an unfixed toner image is heat-and-pressure-fixed on the recording sheet P by the heat and the nip pressure of the fixing film 1A.

The temperature of the fixing film 1A is detected by a temperature detecting element 8 such as a thermistor, and the information of the detected temperature is inputted to a control circuit 9. On the basis of the inputted information of the detected temperature, the control circuit 9 controls the supply of electric power from the excitation circuit 10 to the induction coil 2 so that the temperature of the fixing nip portion N may be controlled to a predetermined fixing temperature.

Again the apparatus of the present embodiment can obtain the effects (1), (2) and (3) similar to those of the heating apparatus 106 of the first embodiment. Others 1) In each of the above-described embodiments, the fixing roller 1 or the fixing film 1A which is a heating rotary member can be made into a construction in which other functional layer such as a mold releasing layer is further laminated on the outer surface thereof.
2) Of course, the present invention can be carried out with the features of the above-described embodiments suitably combined together.
3) The heating apparatus of the present invention can be widely used not only the image heating and fixing apparatuses of the above-described embodiments, but also as other heating apparatuses such as an image heating apparatus for heating a recording material bearing an image thereon and improving the surface property thereof such as luster, an image heating apparatus for heating a recording material bearing an image thereon to thereby tentatively fix the image, and a heating apparatus for feeding a sheet-like article and effecting the processes of drying, smoothing and laminating it.

The present invention is not restricted to the above-described embodiments, but covers modifications within the technical idea thereof.

What is claimed is:

1. An image heating apparatus for heating an image formed on a recording material, comprising:

a heating member; and an excitation coil for generating a magnetic field to induce an eddy current in said heating member;

said heating member having a magnetic metallic layer and a non-magnetic metallic layer, said coil being disposed on said magnetic layer side of said heating member, wherein a length of said magnetic metallic layer in a lengthwise direction is shorter than that of said non-magnetic metallic layer.

2. The image heating apparatus according to claim 1, wherein said heating member is in a form of a rotary member containing said coil therein, and said magnetic metallic layer is provided on an inner side of said non-magnetic metallic layer.

3. The image heating apparatus according to claim 1, wherein said heating member is in a form of a rotary member, said coil is disposed externally of said heating member, and said magnetic metallic layer is provided on an outer side of said non-magnetic metallic layer.

4. The image heating apparatus according to claim 1, wherein an adiabatic member is disposed between said coil and said magnetic metallic layer.

5. The image heating apparatus according to claim 1, wherein end portions of said magnetic metallic layer in the lengthwise direction are thinner than a central portion thereof.

6. The image heating apparatus according to claim 5, wherein end portions of said non-magnetic metallic layer in the lengthwise direction are thicker than a central portion thereof.

7. A heat generating rotary member for use in an image heating apparatus of an electromagnetic induction type, comprising:

a magnetic metallic layer; and a non-magnetic metallic layer provided on an outer side of said magnetic metallic layer, wherein a length of said magnetic metallic layer in a lengthwise direction is shorter than that of said non-magnetic metallic layer.

8. The heat generating rotary member according to claim 7, wherein end portions of said magnetic metallic layer in the lengthwise direction are thinner than a central portion thereof.

9. The heat generating rotary member according to claim 8, wherein end portions of said non-magnetic metallic layer in the lengthwise direction are thicker than a central portion thereof.

* * * * *